US005320570A

United States Patent [19]

Kane

[11] Patent Number: 5,320,570

[45] Date of Patent: Jun. 14, 1994

[54] METHOD FOR REALIZING HIGH FREQUENCY/SPEED FIELD EMISSION DEVICES AND APPARATUS

[75] Inventor: Robert C. Kane, Scottsdale, Ariz.

[73] Assignee: Motorola, Inc., Schaumburg, Ill.

[21] Appl. No.: 7,878

[22] Filed: Jan. 22, 1993

[51] Int. Cl.[5] ..... H01J 1/30; H01J 9/02

[52] U.S. Cl. ..... 445/24; 445/50; 313/336

[58] Field of Search ..... 445/24, 50; 313/309, 313/336

[56] References Cited

U.S. PATENT DOCUMENTS 4,379,979 4/1983 Thomas et al. ..... 445/50
5,053,673 10/1991 Tomii et al. ..... 445/24
5,164,632 11/1992 Yoshida et al. ..... 313/309
5,249,340 10/1993 Kane et al. ..... 445/50

*Primary Examiner*—Paula A. Bradley
*Assistant Examiner*—Jeffrey T. Knapp
*Attorney, Agent, or Firm*—Eugene A. Parsons

[57] ABSTRACT

An improved method of manufacturing high performance field emission devices is set forth which provides for high frequency and high switching speed operation. A field emission device employing an electron emitter is disposed on a projection provides for significant reduction in interelectrode capacitance. A method for forming the improved field emission device includes selective etching of one of the substrate and conductive/semiconductive materials to provide a projection or plurality of projections on which the electron emitter(s) is (are) disposed. The projections may be on the order of 100 μm in extent.

8 Claims, 8 Drawing Sheets

METHOD FOR REALIZING HIGH FREQUENCY/SPEED FIELD EMISSION DEVICES AND APPARATUS

BACKGROUND OF THE INVENTION

This invention relates generally to methods of manufacturing field emission devices and more particularly to methods of manufacturing high frequency/high speed field emission devices.

Field emission devices which may be realized by any of many known configurations suffer from inherent limitations due to attendant interelectrode capacitances.

Some recent attempts to reduce the objectionable interelectrode capacitances have yielded particular geometries, such as those detailed in U.S. Pat. Nos. 5,075,591 and 5,064,396. However, any benefit realized by employing structures detailed in those references are not sufficient to provide for high frequency or high speed field emission device performance.

Accordingly there exists a need to provide an improved field emission device and method which overcomes at least some of the shortcomings of the prior art.

SUMMARY OF THE INVENTION

This need and others are substantially met through provision of a method for forming a high frequency/-speed field emission device including the steps of providing a substrate having a major surface, performing a selective directive etch to remove some of the substrate such that a substantially normal and integral projection is formed, depositing an insulator layer, having a height, onto the substrate and substantially surrounding the projection, depositing an extraction electrode onto the insulator layer, selectively etching an aperture through the extraction electrode and a part of the height of the insulator layer corresponding to the projection such that at least a part of the projection is exposed, and depositing an electron emitter into the aperture and operably coupled to the projection.

In a specific embodiment of a device of the present invention an improved performance field emission device exhibiting significantly reduced interelectrode capacitance is provided by including a projection with a height in the range of approximately 10.0 μm to 100.0 μm.

DETAILED DESCRIPTION OF THE DRAWINGS

Figure 1:
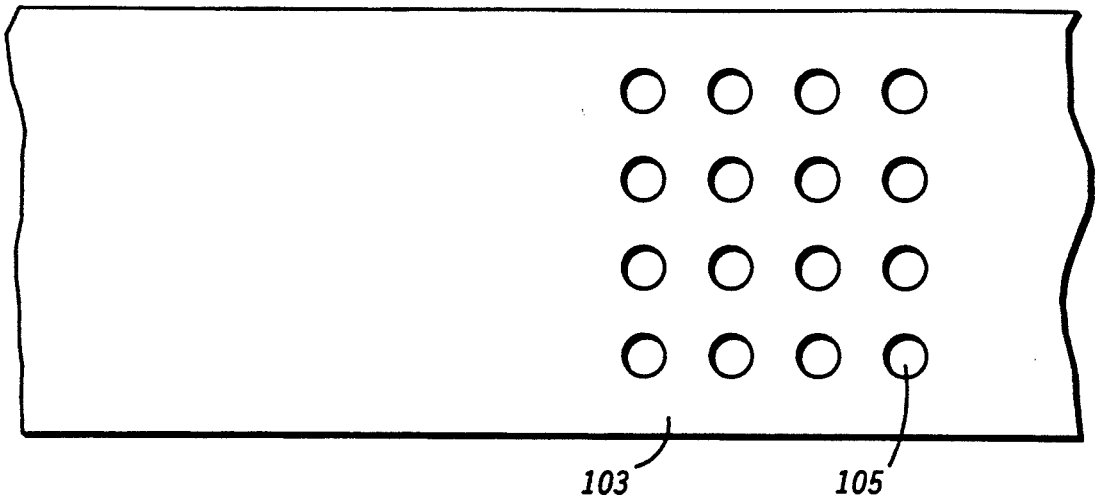
FIG. 1 is a partial top plan view of a plurality of field emission device apertures incorporated within an extraction electrode.
Figure 2:
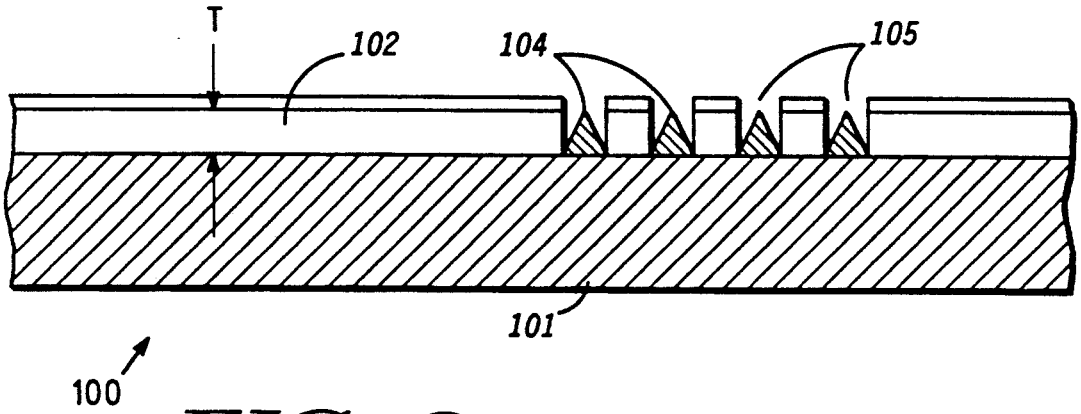
FIG. 2 is a partial side elevational view of a field emission device as first detailed with reference to FIG. 1.

Referring now to FIGS. 1 and 2 there is depicted a top plan view and side elevational view, respectively, of a field emission device (FED). The FED is comprised of a substrate 101 on which is disposed an insulator layer 102 having a thickness, T, and an extraction electrode 103 wherein each of insulator layer 102 and extraction electrode 103 has a plurality of apertures 105 formed therethrough. An electron emitter 104 is disposed in each of the plurality of apertures 105.

Figure 3:
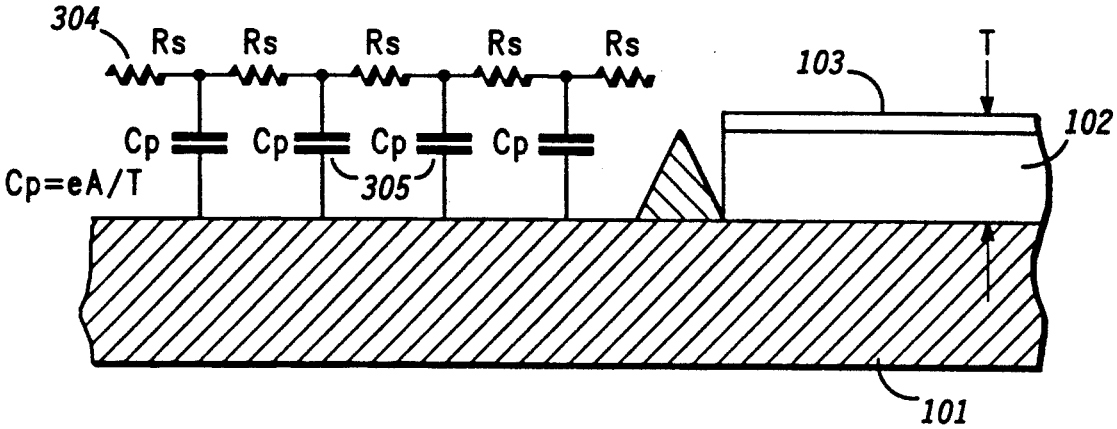
FIG. 3 is a partial schematical representation and partial side elevational view of a field emission device.

FIG. 3 is a partial schematical representation and partial side elevational view of the FED described previously with reference to FIGS. 1 and 2 and wherein features described previously with reference to FIGS. 1 and 2 are designated with similar reference numerals. FIG. 3 further illustrates that the physical structure which comprises extraction electrode 103 and insulator layer 102 may be represented, in the electronic sense, as an equivalent distributed circuit network which network comprises a plurality of interconnected series resistance elements 304 and a plurality of interconnected shunt capacitances 305. The value of each series resistance element 304 is primarily determined by the resistivity of the material of which extraction electrode 103 is realized in addition to the cross sectional geometry and length of extraction electrode 103. The value of each shunt capacitance 305, which may be stated as $Cp=eA/T$, is primarily determined by the permittivity, e, of the material of which insulator layer 102 is formed in addition to the thickness, T, of insulator layer 102, and the geometry (area, A) of insulator layer 102.

Performance limitations of an FED, with respect to high frequency or switching speed, are primarily determined by the associated (equivalent) electronic structure such as that depicted by series resistances 304 and shunt capacitances 305. Improved FED performance may be realized by reducing either or both of the magnitudes of the series resistance and shunt capacitance.

Figure 4:
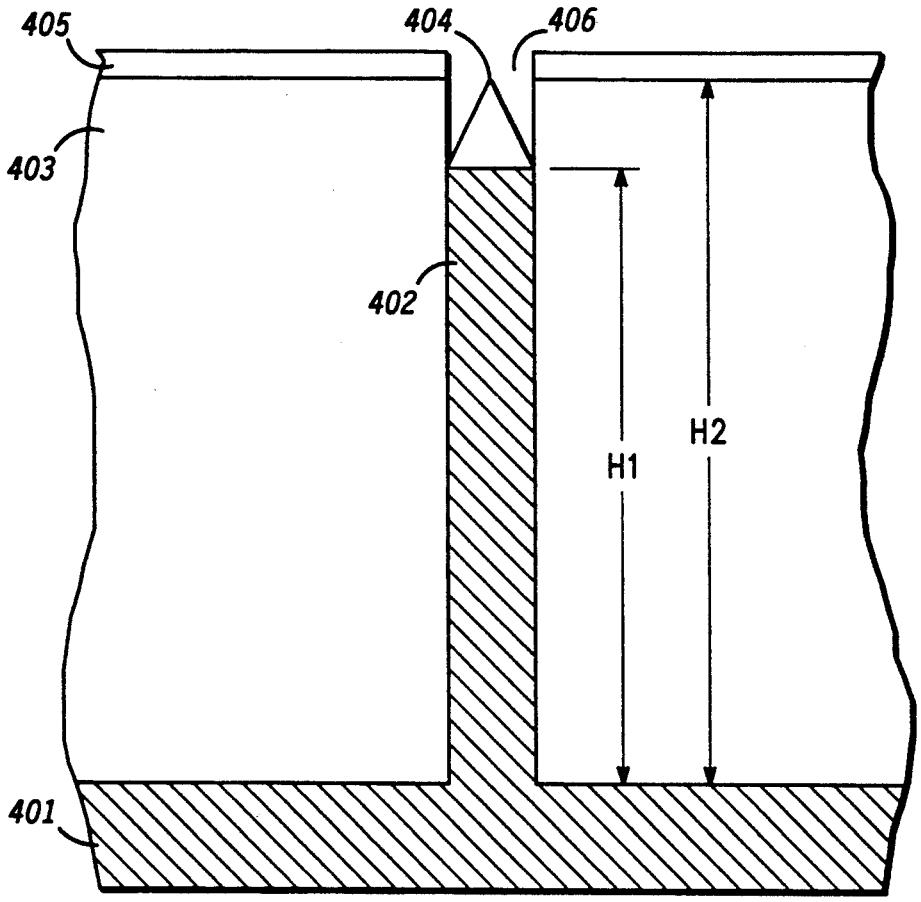
FIG. 4 is a partial side elevational view of an embodiment of a field emission device in accordance with the present invention.

FIG. 4 is a partial side elevational view of an embodiment of a field emission device (FED) in accordance with the present invention. A substrate 401 including a substantially normal projection 402, having a height H1, has disposed thereon an insulator layer 403 having a height, depicted as H2. An extraction electrode 405 is disposed on insulator layer 403. An aperture 406 is defined through extraction electrode 405 and a portion of the thickness (height) of insulator layer 403 substantially co-incident with (corresponding to) projection 402 such that an electron emitter 404 disposed in aperture 406 is operably coupled to projection 402 and lies generally in a plane with extraction electrode 405.

Note that for the device of the present invention as depicted in FIG. 4 height H1 of projection 402 may be on the order of from 10 μm to more than 100 μm. Equivalently, height H2 of insulator layer 403 is also on the order of from 10 μm to 100 μm. As described previously, the shunt interelectrode capacitance of the FED is inversely related to the interelectrode spacing. In the instance of the structure now under consideration it should be observed that the height of insulator layer 403 is from one to two orders of magnitude greater than is known in structures employed in the prior art. Correspondingly, FEDs realized in accordance with the present invention provide for higher frequency operation and higher speed operation of from one to two orders of magnitude over that of the prior art devices.

Figure 5:
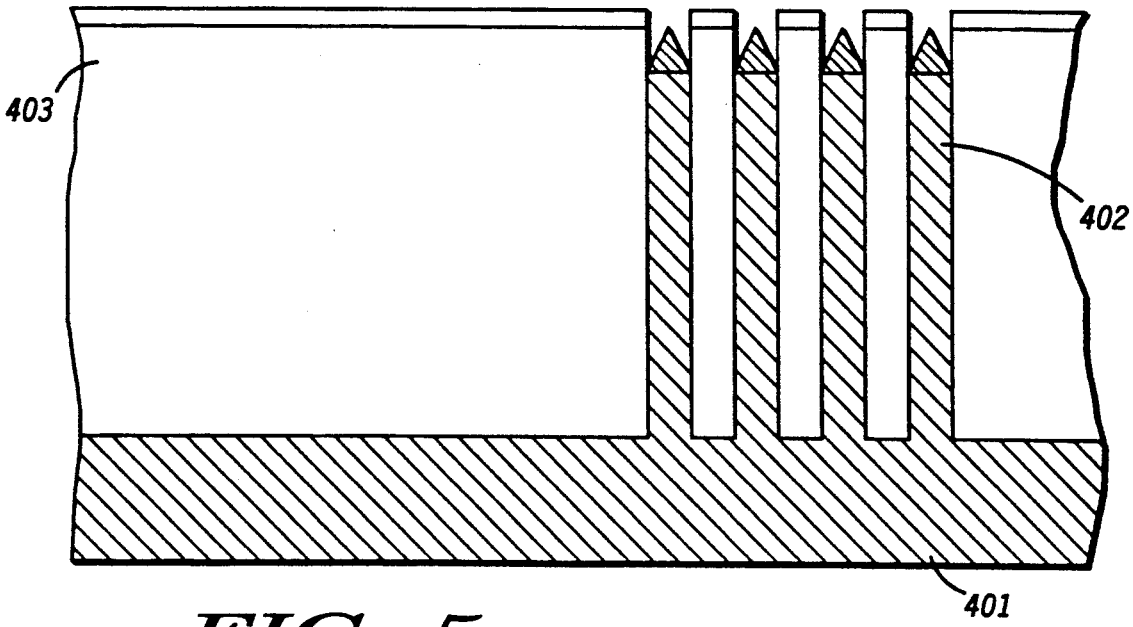
FIG. 5 is a side elevational view of another embodiment of a field emission device in accordance with the present invention.

FIG. 5 is a partial side-elevational view of another embodiment of a FED in accordance with the present invention as described previously with reference to FIG. 4 and having similarly referenced features and further depicting a plurality of projections 402. Commonly, FEDs employ a plurality of electron emitters even to the extent of $10\times10^6/cm^2$. FIG. 5 is representative of such a plurality of electron emitters with associated projections 402.

Figure 6:
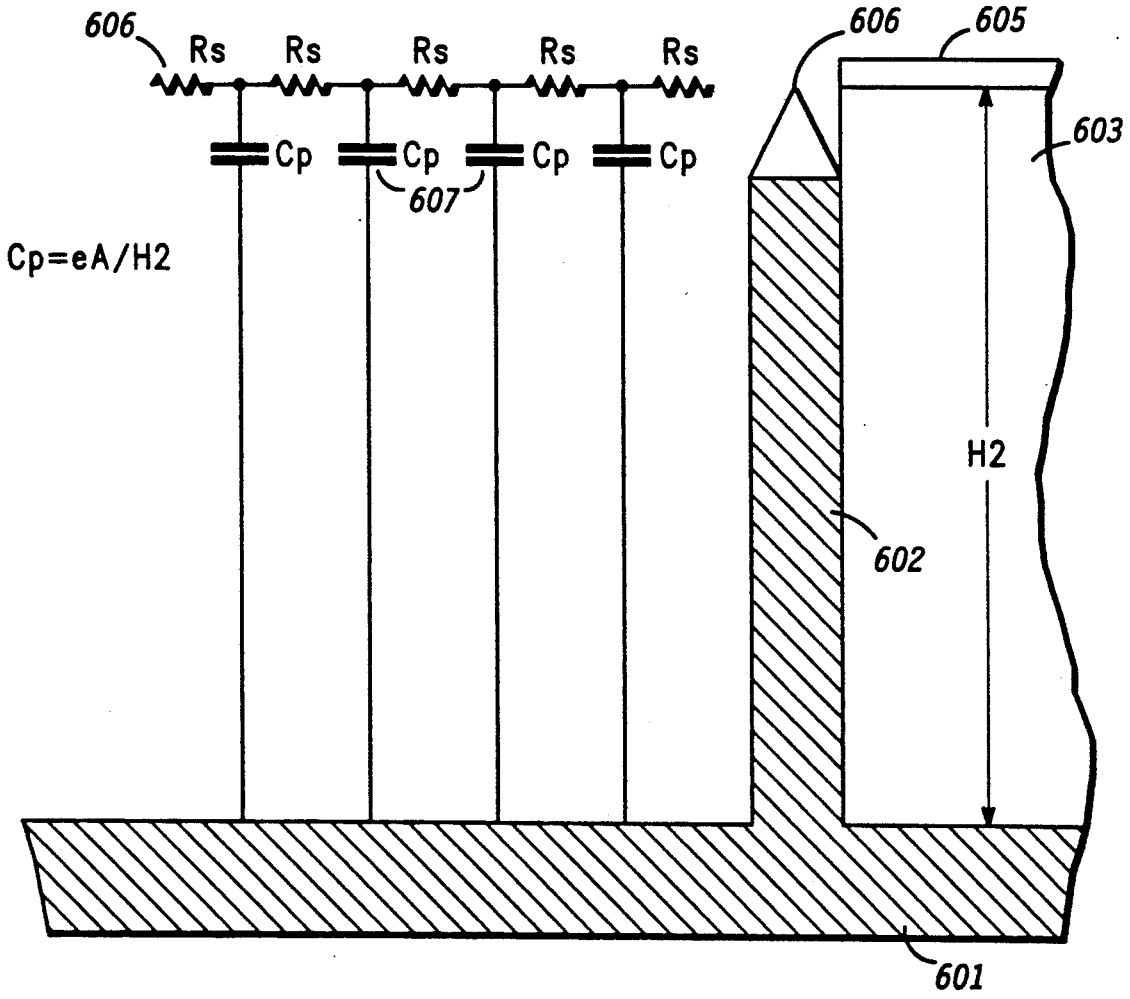
FIG. 6 is a partial schematical representation and partial side elevation view of a field emission device in accordance with the present invention.

FIG. 6 is a partial schematical representation and partial side elevational view of an FED in accordance with the present invention. A substrate 601 including a projection 602 having an electron emitter 606 operably coupled to and disposed thereon is depicted. An extraction electrode 605 is shown proximally disposed about electron emitter 606 on an insulator layer 603. An equivalent distributed electronic circuit network comprises a plurality of equivalent interconnected series resistance elements 606 and a plurality of equivalent interconnected shunt capacitance elements 607. As described previously with reference to FIG. 4, a significant increase in the height of insulator layer 603 provides a corresponding decrease in the shunt capacitance according to the relationship, $$C=eA/H2$$

where C is the shunt capacitance, A is the area of the capacitor plate (in this instance the extraction electrode 605 area), e is the permittivity of the material of which insulator layer 603 is formed, and H2 is the height of insulator layer 603.

Figure 7:
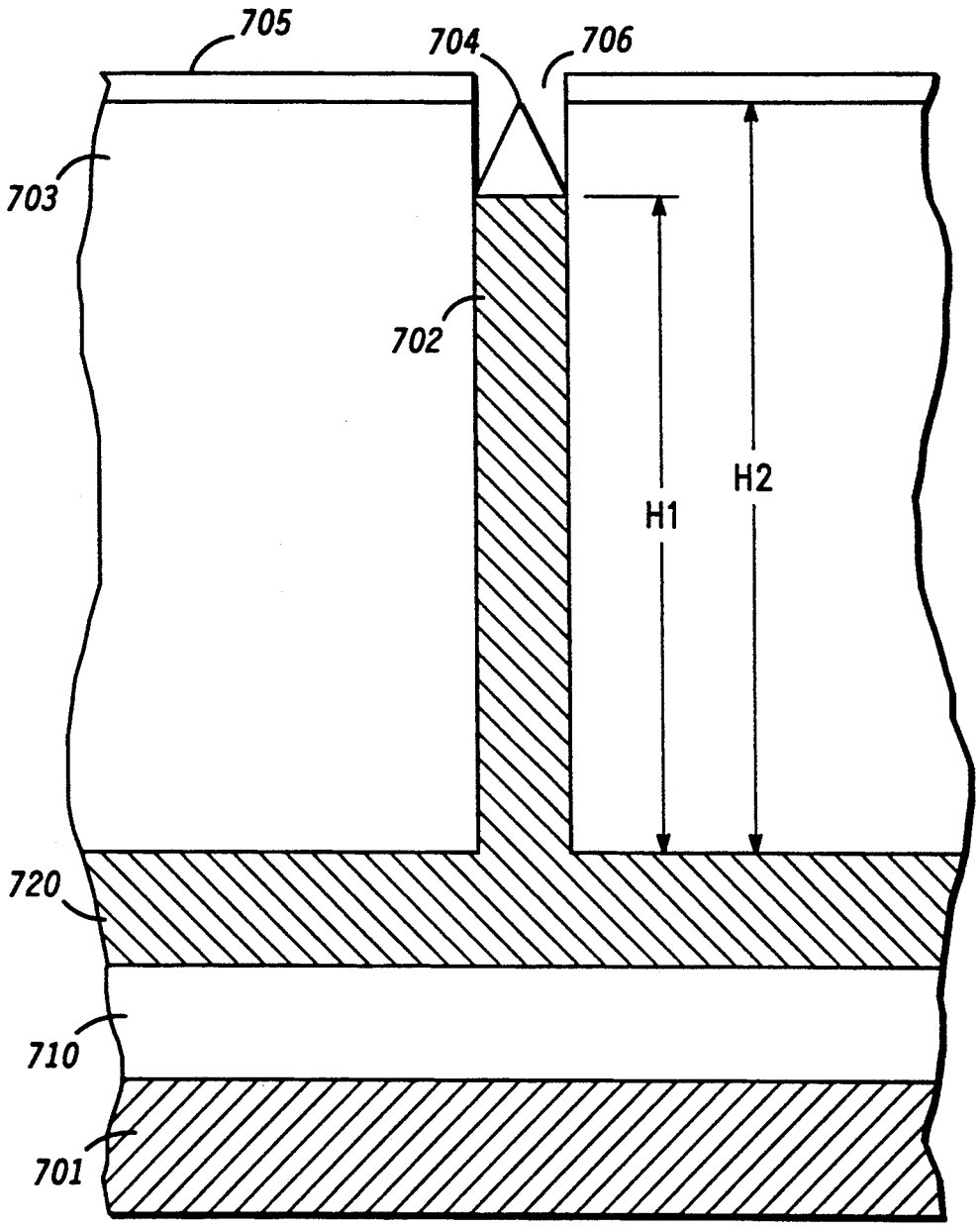
FIG. 7 is a partial side elevational view of yet another embodiment of a field emission device in accordance with the present invention.

Referring now to FIG. 7 there is depicted a side elevational view of yet another embodiment of a field emission deice in accordance with the present invention. A supporting substrate 701 having a major surface on which is disposed a first insulator layer 710 is shown. A layer 720 of conductive/semiconductive material and including a substantially normal projection 702, having a height H1, has disposed thereon a second insulator layer 703 having a height, depicted as H2. The conductive/semiconductive material may be one of conductive materials, such as molybdenum, and/or semiconductive materials, such as silicon. An extraction electrode 705 is disposed on insulator layer 703. An aperture 706 is defined through extraction electrode 705 and a portion of the thickness (height) of insulator layer 703 substantially co-incident with projection 702 such that an electron emitter 704 disposed in aperture 706 is operably coupled to projection 702.

Generally, substrates such as 401, 701 and 901 are formed of conductive material (which may include doped semiconductor material), however,in the event that substrate 701 is or includes an insulative material it may be practical not to include the first insulator layer 710 of FIG. 7.

Figure 8:
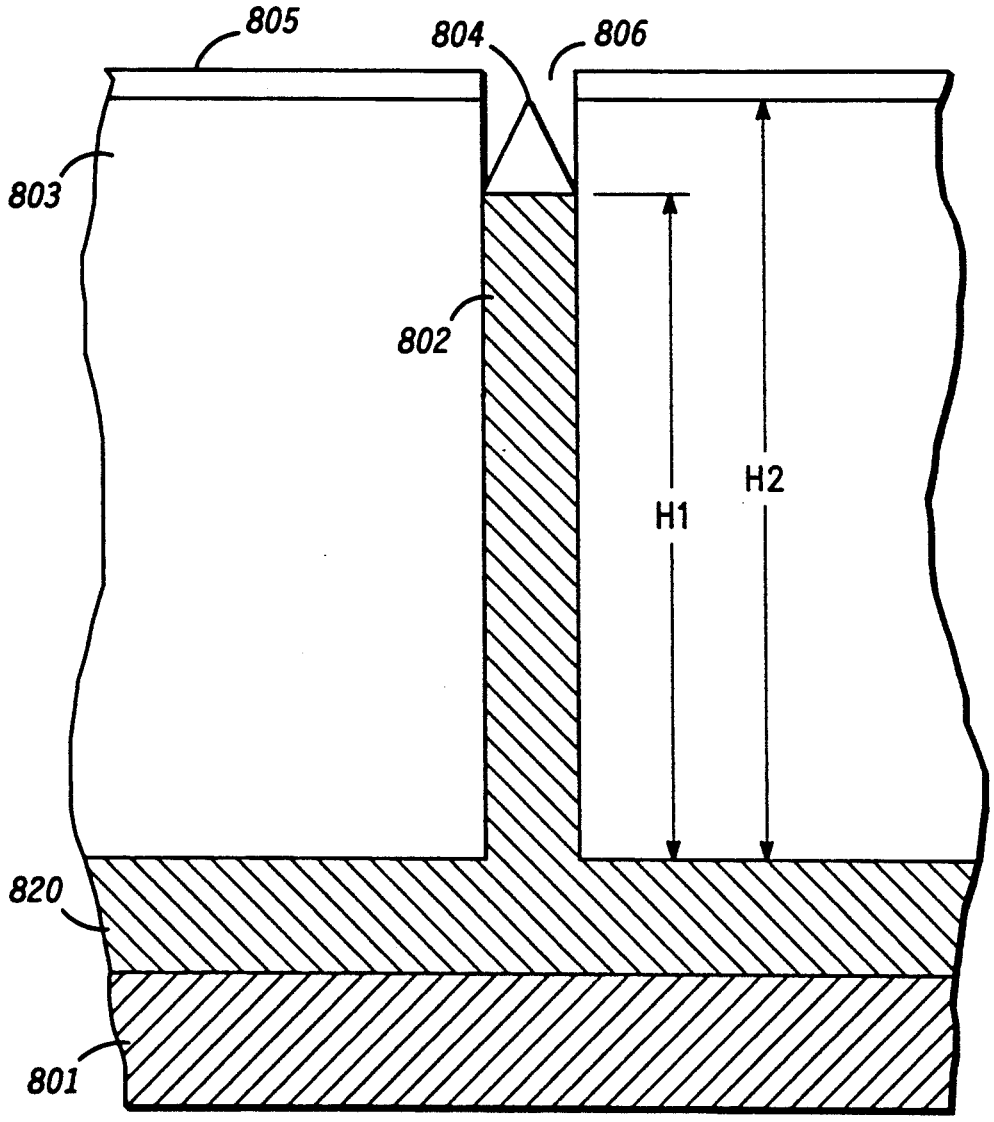
FIG. 8 is a partial side elevational view of still another embodiment of a field emission device in accordance with the present invention.

FIG. 8 is a side elevational view of still another embodiment of a field emission deice in accordance with the present invention. A supporting substrate 801 having a major surface on which is disposed a conductive/semiconductive material 820 including a substantially normal projection 802, having a height H1, has disposed thereon an insulator layer 803 having a height H2. An extraction electrode 805 is disposed on insulator layer 803. An aperture 806 is defined through extraction electrode 805 and a portion of the thickness (height) of insulator layer 803 substantially co-incident with projection 802 such that an electron emitter 804 disposed in aperture 806 is operably coupled to projection 802.

FIGS. 9 through 13 depict various structures realized by performing various steps in accordance with a method for forming FEDs in accordance with the present invention. It should be understood that the method described is for illustrative purposes only and that variations not depicted may be employed to realize similar structures and fall within the scope of the present disclosure. Further, it is understood that variation in method steps to be subsequently detailed may provide for the realization of field emission devices such as those detailed previously with reference to FIGS. 7 and 8.

Figure 9:
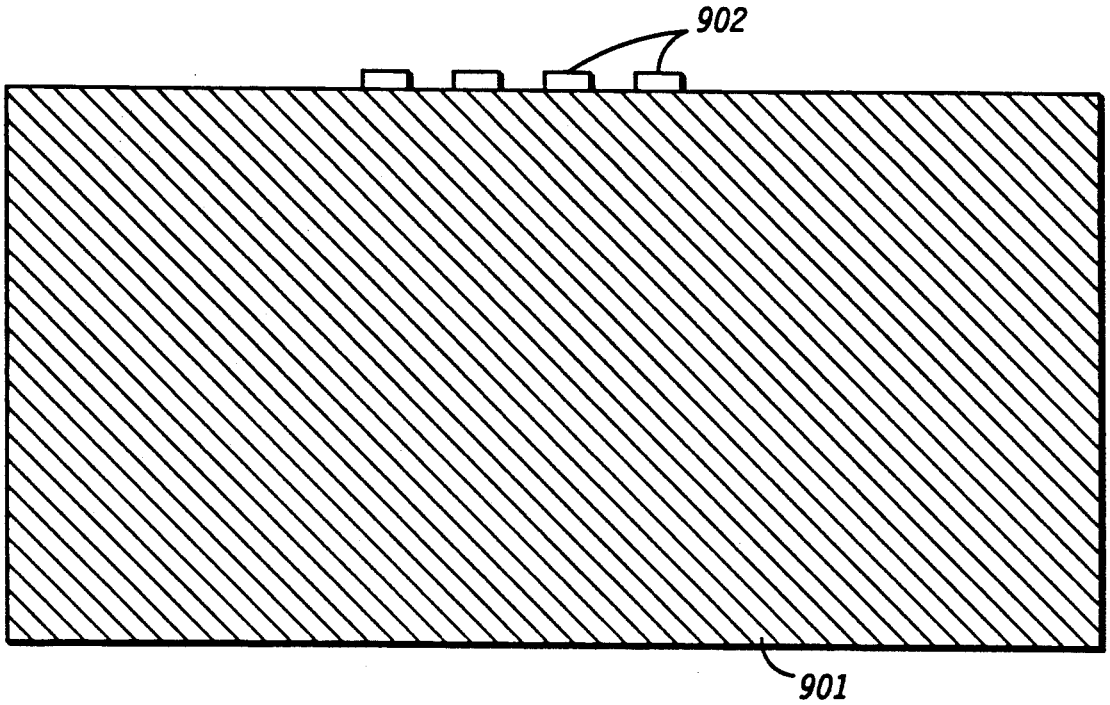
FIGS. 9–13 are side elevational views of structures realized by performing various steps of a method for forming a field emission device in accordance with the present invention.

FIG. 9 is a side elevational view of a structure formed in accordance with a method of the present invention including a substrate 901 on which is deposited a selectively patterned layer of material, such as, for example, photoresist or a hard mask such as gold, which comprises a mask 902.

Figure 10:
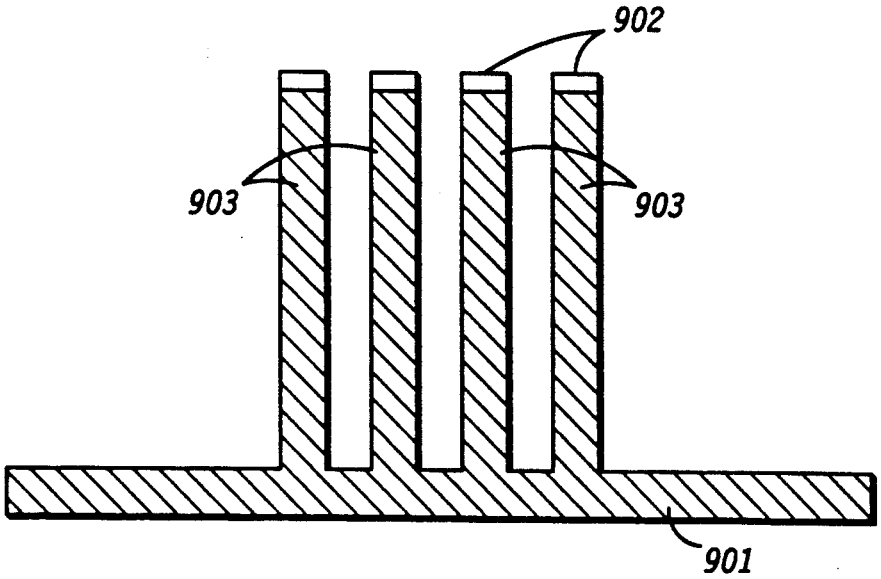

FIG. 10 is a side elevational view of a structure similar to FIG. 9 having undergone a further step of performing a selective directive etch, such as a reactive ion etch, to remove some of the material of substrate 901 such that a plurality of substantially normal and integral projections 903 are formed. It should be observed that the integral projections are realized as the etch is inhibited at regions corresponding to the selectively patterned mask 902.

Figure 11:
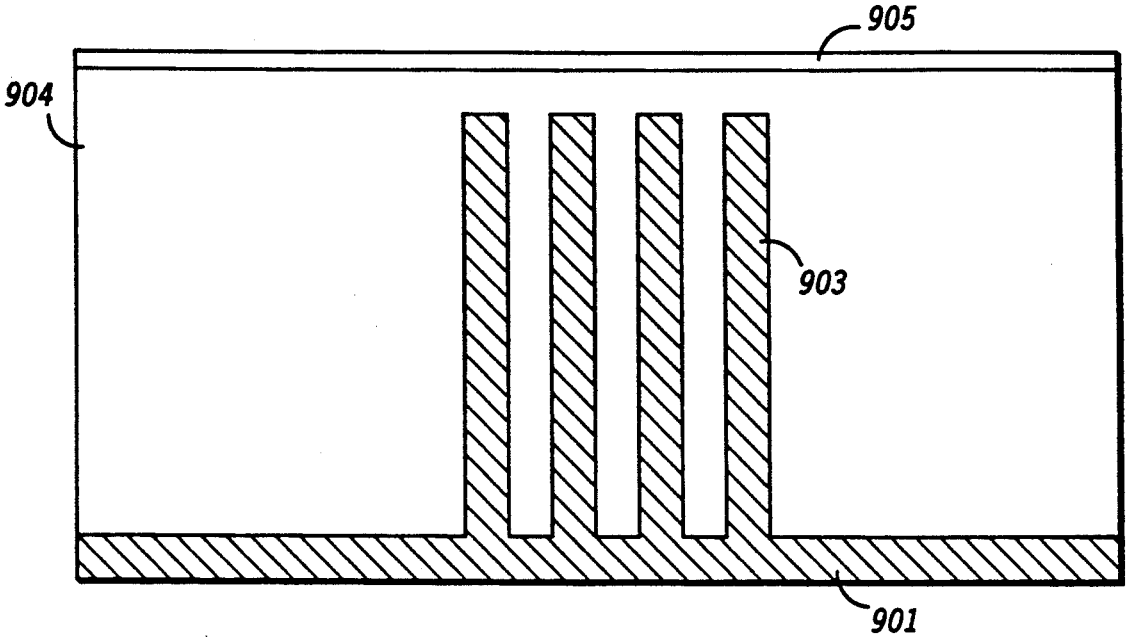

FIG. 11 is a side elevational view of a structure similar to FIG. 10 realized by performing additional steps of the method including; removing mask 902, depositing an insulator layer 904 onto substrate 901, and depositing an extraction electrode 905 onto insulator layer 904.

Figure 12:
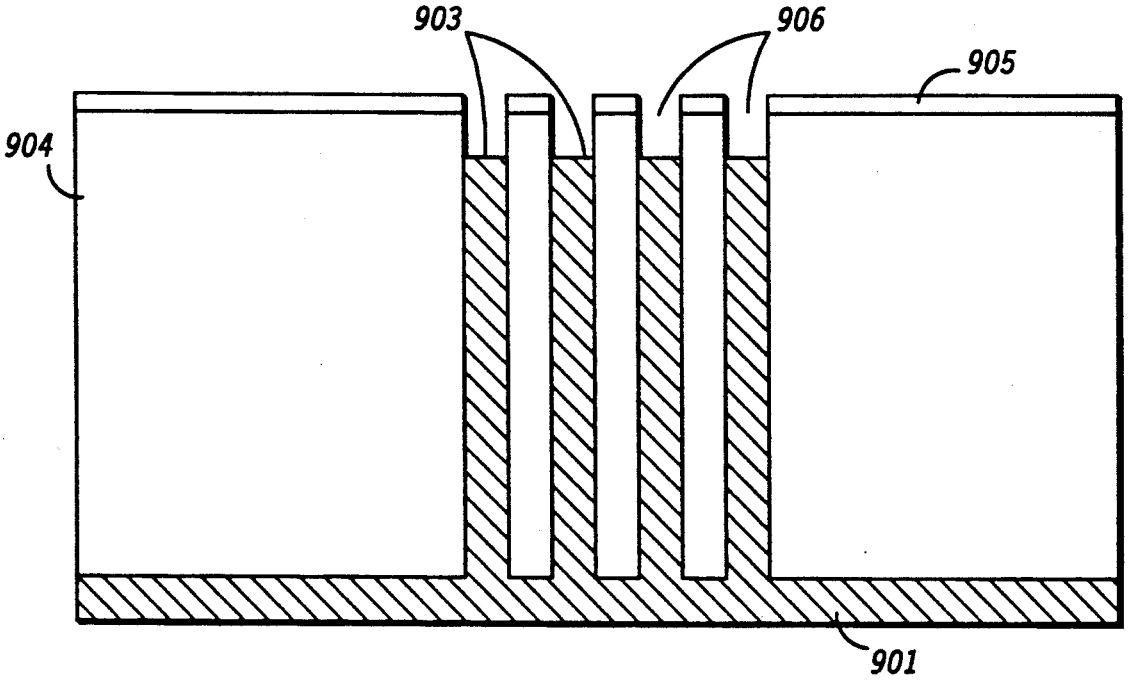

FIG. 12 is a side elevational view of a structure similar to FIG. 11 realized by performing another step of the method including selectively etching a plurality of apertures 906, each of which plurality of apertures corresponds to one of the plurality of projections 903, through extraction electrode 905 and a part of height H2 of insulator layer 904 such that a part of projections 903 is exposed.

Figure 13:
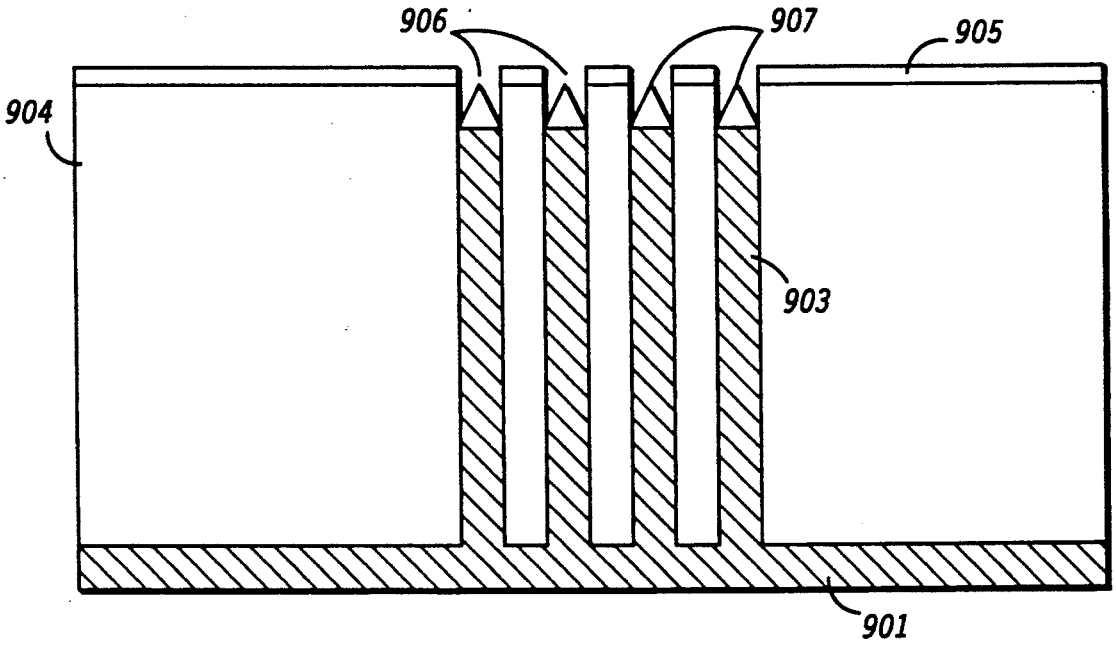

FIG. 13 is a side elevational view of a structure similar to FIG. 12 realized by performing yet another step of the method including depositing an electron emitter 907 into at least some of the plurality of apertures 906 and operably coupled to a projection of the plurality of projections 903.

It is noted that, although the method described provides for realization of a field emission device apparatus which employs a plurality of projections and associated electron emitters, the method may be employed to provide an apparatus of a single projection and electron emitter such as that depicted with reference to FIG. 4.

By providing projections of 100 μm or more in height it is evident that the associated shunt capacitance is reduced by two orders of magnitude or more. High frequency field emission device applications such as RF and microwave power devices may be practically realized by the apparatus and method of the present disclosure. Additionally, high speed switching devices such as those commonly employed in computer processing and memory circuits may be realized.

What is claimed is:

1. A method for forming a high frequency/speed field emission device including the steps of:

providing a substrate having a major surface;

performing a selective directive etch to remove some of the substrate such that a substantially normal and integral projection is formed;

depositing an insulator layer, having a height, onto the substrate and substantially surrounding the projection;

depositing an extraction electrode onto the insulator layer;

selectively etching an aperture through the extraction electrode and a part of the height of the insulator layer corresponding to the projection such that at least a part of the projection is exposed; and depositing an electron emitter into the aperture and operably coupling the emitter to the projection.

2. A method for forming a high frequency/speed field emission device as claimed in claim 1 wherein the step of performing a selective directive etch is continued until sufficient material of the substrate is removed such that a substantially normal projection is formed with a height greater than approximately 10.0 μm.

3. A method for forming a high frequency/speed field emission device as claimed in claim 1 wherein the step of performing a selective directive etch is continued until sufficient material of the substrate is removed such that a substantially normal projection is formed with a height in the range of approximately 10.0 μm to 100.0 μm.

4. A method for forming a high frequency/speed field emission device as claimed in claim 3 wherein the step of depositing an insulator layer, having a height, onto the substrate includes depositing an insulator layer having a height in the range of approximately 10.0 μm to 100.0 μm, so as to place the electron emitter generally in a plane with the extraction electrode.

5. A method for forming a high frequency/speed field emission device including the steps of:

providing a substrate having a major surface;

depositing a selectively patterned mask onto the major surface;

performing a selective directive etch to remove some of the substrate substantially other than at regions corresponding to the selectively patterned mask such that a substantially normal projection is formed at an unetched region of the substrate;

removing the selectively patterned mask;

depositing an insulator layer, having a height, onto the substrate;

depositing an extraction electrode onto the insulator layer;

selectively etching an aperture through the extraction electrode and a part of the height of the insulator layer corresponding to the projection such that at least a part of the projection is exposed; and depositing an electron emitter into the aperture and operably coupling the emitter to the projection.

6. A method for forming a high frequency/speed field emission device as claimed in claim 5 wherein the step of performing a selective directive etch is continued until sufficient material of the substrate is removed such that a substantially normal projection is formed with a height greater than approximately 10.0 μm.

7. A method for forming a high frequency/speed field emission device as claimed in claim 5 wherein the step of performing a selective directive etch is continued until sufficient material of the substrate is removed such that a substantially normal projection is formed with a height in the range of approximately 10.0 μm to 100.0 μm.

8. A method for forming a high frequency/speed filed emission device as claimed in claim 7 wherein the step of depositing an insulator layer, having a height, onto the substrate includes depositing an insulator layer having a height in the range of approximately 10.0 μm to 100.0 μm, so as to place the electron emitter generally in a plane with the extraction electrode.

* * * * *